US011434696B2

(12) United States Patent
Sihler et al.

(10) Patent No.: US 11,434,696 B2
(45) Date of Patent: Sep. 6, 2022

(54) DIRECTIONAL DRILLING SYSTEMS AND METHODS

(71) Applicant: Schlumberger Technology Corporation, Sugar Land, TX (US)

(72) Inventors: Joachim Sihler, Cambridge (GB); Mauro Caresta, Cambridge (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 130 days.

(21) Appl. No.: 16/025,523

(22) Filed: Jul. 2, 2018

(65) Prior Publication Data

US 2020/0003011 A1 Jan. 2, 2020

(51) Int. Cl.
*E21B 7/06* (2006.01)
*E21B 17/10* (2006.01)

(52) U.S. Cl.
CPC ..... *E21B 7/062* (2013.01); *E21B 7/06* (2013.01); *E21B 17/1064* (2013.01)

(58) Field of Classification Search
CPC ..... E21B 7/06; E21B 7/062; E21B 17/1064
See application file for complete search history.

(56) References Cited

U.S. PATENT DOCUMENTS 1,635,593 A 7/1927 Wadsworth
2,142,859 A * 1/1939 McMahan ..... E21B 7/062 175/73
2,179,567 A * 11/1939 Strength ..... E21B 7/062 175/73
2,197,227 A * 4/1940 Strength ..... E21B 47/024 175/45
2,212,594 A * 8/1940 Harry ..... E21B 7/06 175/81
3,297,100 A 1/1967 Crews
4,083,415 A 4/1978 Kita et al.
4,106,823 A 8/1978 Bassinger
4,947,944 A * 8/1990 Coltman ..... E21B 7/062 175/325.3
4,948,925 A 8/1990 Winters et al.
5,601,151 A * 2/1997 Warren ..... E21B 7/06 175/61

(Continued)

FOREIGN PATENT DOCUMENTS

WO 2015127345 A2 8/2015
WO 2016187373 A1 11/2016

OTHER PUBLICATIONS

International Preliminary Report on Patentability issued in International Patent Application No. PCT/US2018/025986 dated Oct. 17, 2019, 14 pages.

(Continued)

*Primary Examiner* — Cathleen R Hutchins

(57) ABSTRACT

A directional drilling system that includes a drill bit capable of drilling a bore through rock. A shaft couples to the drill bit. The shaft transfers rotational power from a motor to the drill bit. A steering system controls a drilling direction of the drill bit. The steering system includes a sleeve coupled to the shaft. A steering pad couples to the sleeve. The steering pad forms a steering angle with the drill bit. Axial movement of the steering pad with respect to the drill bit changes the drilling direction by changing the steering angle.

19 Claims, 9 Drawing Sheets

(56) References Cited

U.S. PATENT DOCUMENTS

| | | | | |
|---|---|---|---|---|
| 5,931,239 | A * | 8/1999 | Schuh | E21B 7/062 175/107 |
| 5,941,323 | A | 8/1999 | Warren | |
| 8,534,380 | B2 | 9/2013 | Sheppard et al. | |
| 8,727,036 | B2 | 5/2014 | Johnson et al. | |
| 8,899,352 | B2 | 12/2014 | Johnson et al. | |
| 9,109,402 | B1 | 8/2015 | Lasater et al. | |
| 9,714,543 | B2 | 7/2017 | Downie et al. | |
| 2002/0179336 | A1 | 12/2002 | Schaaf et al. | |
| 2006/0144623 | A1* | 7/2006 | Ollerensaw | E21B 7/062 175/269 |
| 2008/0115974 | A1 | 5/2008 | Johnson et al. | |
| 2009/0044980 | A1* | 2/2009 | Sheppard | E21B 7/06 175/24 |
| 2010/0116551 | A1 | 5/2010 | Southard | |
| 2010/0139983 | A1 | 6/2010 | Hallworth et al. | |
| 2011/0139513 | A1 | 6/2011 | Downton | |
| 2012/0080235 | A1 | 4/2012 | Sheppard et al. | |
| 2013/0213713 | A1 | 8/2013 | Smith et al. | |
| 2014/0262507 | A1 | 9/2014 | Marson et al. | |
| 2016/0060959 | A1 | 3/2016 | Lehr et al. | |
| 2016/0060960 | A1 | 3/2016 | Parkin et al. | |
| 2017/0002608 | A1 | 1/2017 | Davis et al. | |
| 2017/0058617 | A1 | 3/2017 | Bartel | |
| 2018/0283103 | A1 | 10/2018 | Caresta | |
| 2020/0003009 | A1 | 1/2020 | Caresta et al. | |
| 2020/0003010 | A1 | 1/2020 | Bittleston et al. | |

OTHER PUBLICATIONS

Office Action issued in U.S. Appl. No. 16/025,480 dated Jan. 14, 2020, 8 pages.

Combined Search and Exam Report under Sections 17 and 18(3) United Kingdom Patent Application No. 1705424.8 dated Jul. 27, 2017, 5 pages.

International Search Report and Written Opinion issued in International Patent Application No. PCT/US2018/025986 dated Jul. 27, 2018, 16 pages.

Office Action issued in U.S. Appl. No. 15/945,158 dated Jan. 18, 2019, 8 pages.

Office Action issued in U.S. Appl. No. 16/025,441 dated Jul. 13, 2020, 15 pages.

First Office Action issued in Chinese Patent Application 201880042655.1 dated Oct. 28, 2020, 11 pages with partial English translation.

Office Action issued in U.S. Appl. No. 16/025,441 dated Feb. 12, 2021.

Office Action issued in U.S. Appl. No. 16/826,976 dated Mar. 3, 2021.

* cited by examiner

DIRECTIONAL DRILLING SYSTEMS AND METHODS

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

The present disclosure generally relates to a directional drilling assembly for directionally drilling a borehole in an earth formation. Directional drilling is the intentional deviation of a borehole from the path it would naturally take, which may include the steering of a drill bit so that it travels in a predetermined direction. In many industries, it may be desirable to directionally drill a borehole through an earth formation in order to, for example, circumvent an obstacle and/or to reach a predetermined location in a rock formation.

In the oil and gas industry, boreholes are drilled into the earth to access natural resources (e.g., oil, natural gas, water) below the earth's surface. These boreholes may be drilled on dry land or in a subsea environment. In order to drill a borehole for a well, a rig is positioned proximate the natural resource. The rig suspends and powers a drill bit coupled to a drill string that drills a bore through one or more layers of sediment and/or rock. After accessing the resource, the drill string and drill bit are withdrawn from the well and production equipment is installed. The natural resource(s) may then flow to the surface and/or be pumped to the surface for shipment and further processing.

Directional drilling techniques have been developed to enable drilling of multiple wells from the same surface location with a single rig, and/or to extend wellbores laterally through their desired target formation(s) for improved resource recovery. Each borehole may change direction multiple times at different depths between the surface and the target reservoir by changing the drilling direction. The wells may access the same underground reservoir at different locations and/or different hydrocarbon reservoirs. For example, it may not be economical to access multiple small reservoirs with conventional drilling techniques because setting up and taking down a rig(s) can be time consuming and expensive. However, the ability to drill multiple wells from a single location and/or to drill wells with lateral sections within their target reservoir(s) may reduce cost and environmental impact.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates generally to systems and methods for directionally drilling a borehole. In embodiments, a directional drilling system includes a drill bit capable of drilling a bore through rock. A shaft couples to the drill bit. The shaft transfers rotational power from a motor to the drill bit. A steering system controls a drilling direction of the drill bit. The steering system includes a sleeve coupled to the shaft. A steering pad couples to the sleeve. The steering pad forms a steering angle with the drill bit. Axial movement of the steering pad with respect to the drill bit changes the drilling direction by changing the steering angle.

In embodiments, a directional drilling system that includes a drill bit capable of drilling a bore through rock. A shaft couples to the drill bit. The shaft transfers rotational power from a motor to the drill bit. A steering system controls a drilling direction of the drill bit. The steering system includes a steering sleeve coupled to the shaft. A steering pad couples to the steering sleeve. The steering pad is configured to form a steering angle with the drill bit. Axial movement of the steering sleeve with respect to the drill bit changes the drilling direction by changing the steering angle.

In embodiments, a directional drilling system with a steering system that controls a drilling direction of a drill bit. The steering system includes a sleeve and a steering pad coupled to the sleeve. The steering pad forms a steering angle with the drill bit. Axial movement of the steering pad with respect to the drill bit changes the drilling direction by changing the steering angle.

Additional details regarding operations of the steering systems and methods of the present disclosure are provided below with reference to FIGS. 1-9.

Various refinements of the features noted above may be made in relation to various aspects of the present disclosure. Further features may also be incorporated in these various aspects as well. These refinements and additional features may be made individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION

Figure 1:
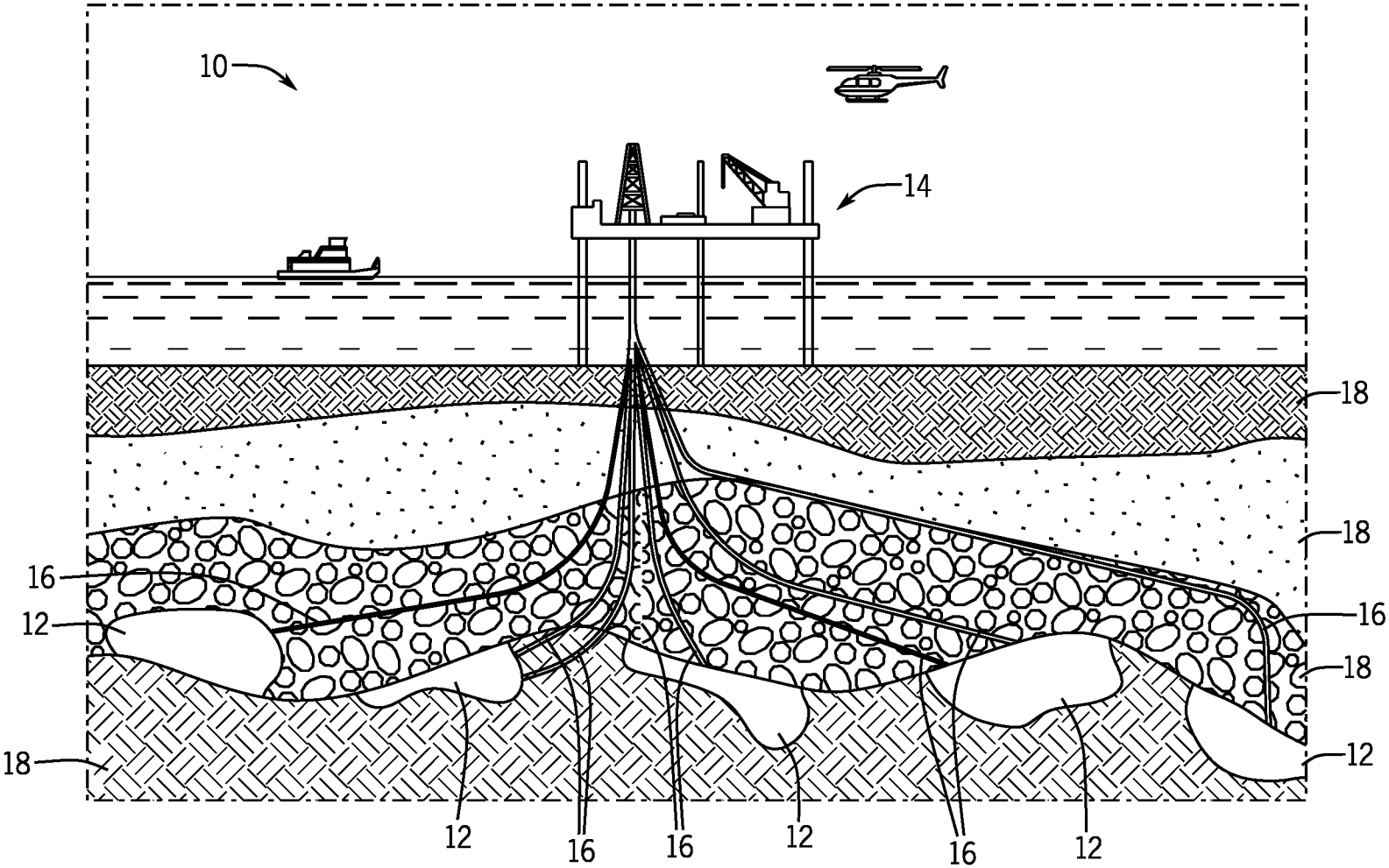
FIG. 1 schematically illustrates a rig coupled to a plurality of wells for which the rotary steering systems and methods of the present disclosure can be employed to directionally drill the boreholes.

One or more specific embodiments will be described below. These described embodiments are only exemplary. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The drawing figures are not necessarily to scale. Certain features of the embodiments may be shown exaggerated in scale or in somewhat schematic form, and some details of conventional elements may not be shown in the interest of clarity and conciseness. Although one or more embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

When introducing elements of various embodiments of the present disclosure, the articles "a," "an," and "the" are intended to mean that there are one or more of the elements. The terms "including" and "having" are used in an open-ended fashion, and thus should be interpreted to mean "including, but not limited to." Any use of any form of the terms "couple," "connect," "attach," "mount," or any other term describing an interaction between elements is intended to mean either a direct or an indirect interaction between the elements described. Moreover, any use of "top," "bottom," "above," "below," "upper," "lower," "up," "down," "vertical," "horizontal," "left," "right," and variations of these terms is made for convenience but does not require any particular orientation of components.

Certain terms are used throughout the description and claims to refer to particular features or components. As one skilled in the art will appreciate, different persons may refer to the same feature or component by different names. This document does not intend to distinguish between components or features that differ in name but not function, unless specifically stated.

The discussion below describes rotary steering systems and methods for controlling the orientation of a drill bit while drilling a borehole. The steering assemblies of the present disclosure are disposed above the drill bit and include one or more over-gauge pads, where "over-gauge" refers to the pad having one or more points of extension greater than a nominal full-gauge or "gauge" as defined by a maximum drill bit cutter tip extension in a radial direction. Thus, for example, the radius of an over-gauge pad at a particular point is greater than the full-gauge radius of the drill bit in that radial direction. In embodiments, an over-gauge pad may include full-gauge and/or under-gauge area(s), where under-gauge refers to having one or more points of extension less than gauge as defined by a maximum drill bit cutter tip extension in that radial direction. Over-gauge pads will be referred to as "steering pads" below.

FIG. 1 schematically illustrates an exemplary drill site 10 in which the directional drilling systems and methods of the present disclosure can be employed. The drill site 10 may be located either offshore (as shown) or onshore, near one or multiple hydrocarbon-bearing rock formations or reservoirs 12 (e.g., for the production of oil and/or gas), or near one or more other subsurface earth zone(s) of interest. Using directional drilling and the rotary steering systems and methods presently described, a drilling rig 14 with its related equipment can drill multiple subsurface boreholes for wells 16 beginning from a single surface location for a vertical bore. Once completed. these wells 16 may fluidly connect to the same hydrocarbon reservoir 12 at different locations and/or to different reservoirs 12 in order to extract oil and/or natural gas.

As illustrated, each well 16 may define a different trajectory, including for example different degrees and/or lengths of curvature, in order to access and/or maximize surface area for production within the hydrocarbon reservoir(s) 12. The trajectory of a well 16 may depend on a variety of factors, including for example the distance between target reservoir(s) 12 and the rig 14, horizontal extension of a reservoir for hydrocarbon capture, as well as predicted and/or encountered rock stratigraphy, drilling obstacles, etc. between the surface and the subsurface drilling target(s). There may varying rock formation layers 18 between the rig 14 and a hydrocarbon reservoir 12, with some of layers 18 easily and relatively quickly drilled through, and other layers 18 time consuming and subject to increased wear on drilling components. The optimal trajectory to access a hydrocarbon reservoir 12 therefore may not be the shortest distance between the rig 14 and the hydrocarbon reservoir 12.

A drilling plan may be developed to include a trajectory for each proposed well 16 that takes into account properties (e.g., thicknesses, composition) of the layers 18. Following the drilling plan, borehole(s) for the well(s) 16 may be drilled to avoid certain layers 18 and/or drill through thinner portions of difficult layers 18 using directional drilling and/or to extend a substantially horizontal section through a reservoir 12. Directional drilling may therefore reduce drill time, reduce wear on drilling components, and fluidly connect the well 16 at or along a desired location in the reservoir 12, among other factors.

In FIG. 1, the rig 14 is an offshore drilling rig using directional drilling to drill the wells 16 below a body of water. It should be understood that directional drilling may be done with onshore rigs as well. Moreover, while the wells 16 may be wells for oil and gas production from hydrocarbon-bearing reservoirs, directional drilling is and can be performed for a variety of purposes and with a variety of targets within and outside of the oil and gas industry, including without limitation in water, geothermal, mineral, and exploratory applications. Additionally, while FIG. 1 illustrates multiple well 16 trajectories extending from one rig 14 surface location, the number of wells extending from the same or similar surface location may be one or otherwise may be more or less than shown.

Figure 2:
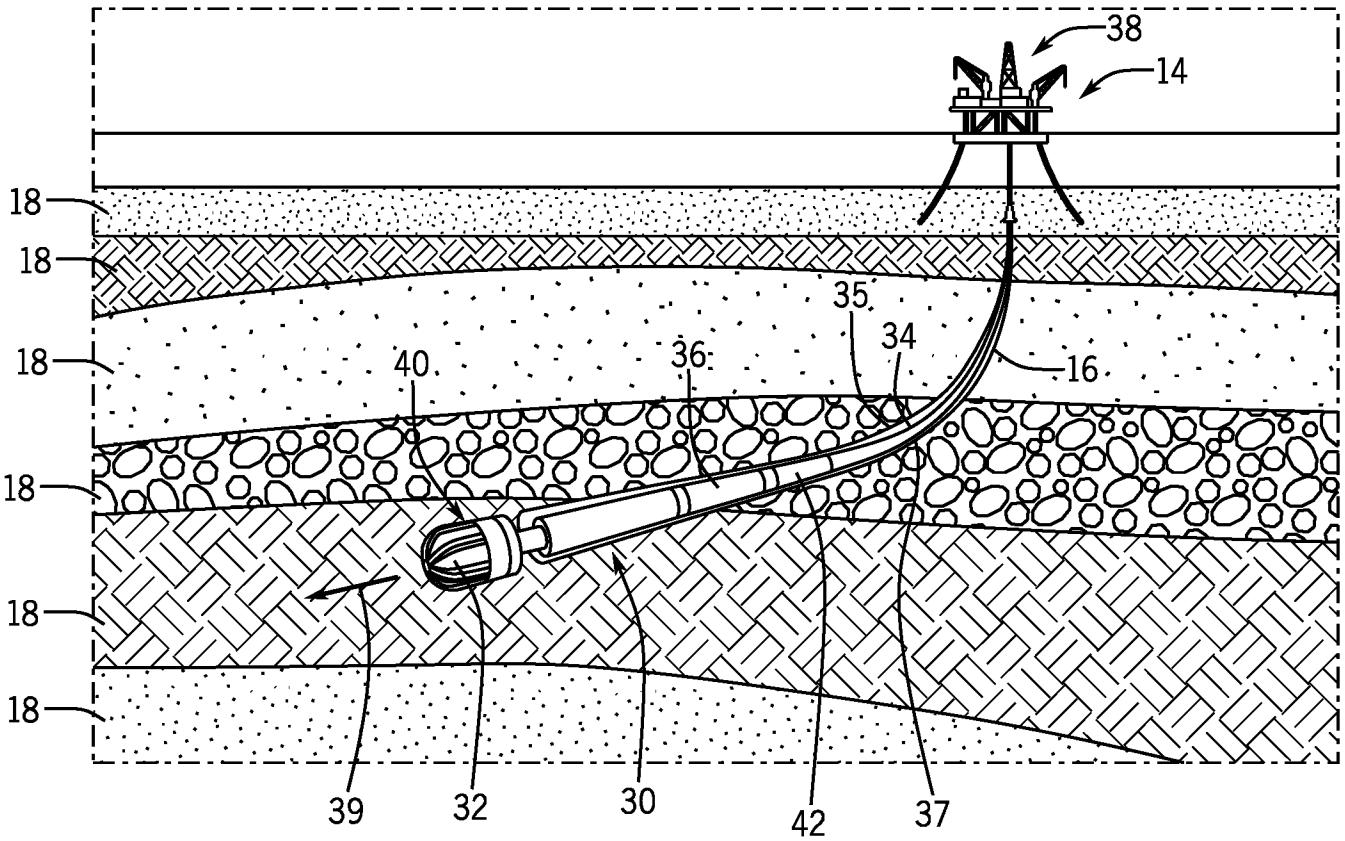
FIG. 2 schematically illustrates an exemplary directional drilling system coupled to a rig according to an embodiment of the present disclosure.

FIG. 2 schematically illustrates an exemplary directional drilling system 30 coupled to a rig 14. The directional drilling system 30 includes at bottom a drill bit 32 designed to break up rock and sediments into cuttings. The drill bit 32 couples to the rig 14 using a drill string 34. The drill string 34 is formed with a series of conduits, pipes or tubes that couple together between the rig 14 and the drill bit 32. In order to carry the cuttings away from the drill bit 32 during a drilling operation, drilling fluid, also referred to as drilling mud or mud, is pumped from surface through the drill string 34 and exits the drill bit 32. The drilling mud then carries the cuttings away from the drill bit 32 and toward the surface through an annulus 35 between an inner wall of the borehole 37 formed by the drill bit 32 and an outer wall of the drill string 34. By removing the cuttings from the borehole 37 for a well 16, the drill bit 32 is able to progressively drill further into the earth.

In addition to carrying away the cuttings, the drilling mud may also power a hydraulic motor 36 also referred to as a mud motor. Drilling mud is pumped into the borehole 37 at high pressures in order to carry the cuttings away from the drill bit 32, which may be at a significant lateral distance and/or vertical depth from the rig 14. As the mud flows through the drill string 34, it enters a hydraulic motor 36. The flow of mud through the hydraulic motor 36 drives rotation of the hydraulic motor 36, which in turn rotates a shaft coupled to the drill bit 32. As the shaft rotates, the drill bit 32 rotates, enabling the drill bit 32 to cut through rock and sediment. In some embodiments, the hydraulic motor 36 may be replaced with an electric motor that provides power to rotate the drill bit 32. In still other embodiments, the directional drilling system 30 may not include a hydraulic motor or electric motor on the drill string 34. Instead, the drill bit 32 may rotate in response to rotation of the drill string 34 from at or near the rig 14, for example by a top drive 38 on the rig 14, or a kelly drive and rotary table, or by any other device or method that provides torque to and rotates the drill string 34.

In order to control a drilling direction 39 of the drill bit 32, the directional drilling system 30 may include a rotary steering system 40 of the present disclosure. As will be discussed in detail below, the rotary steering system 40 includes a steering sleeve with one or more steering pads oriented to change and control the drilling direction 39 of the drill bit 32. The rotary steering system 40 may be controlled by an operator and/or autonomously using feedback from a measurement-while-drilling system 42. The measurement-while-drilling system 42 uses one or more sensors to determine the well path or borehole drilling trajectory in three-dimensional space. The sensors in the measurement-while-drilling system 42 may provide measurements in real-time and/or may include accelerometers, gyroscopes, magnetometers, position sensors, flow rate sensors, temperature sensors, pressure sensors, vibration sensors, torque sensors, and/or the like, or any combination of them.

Figure 3:
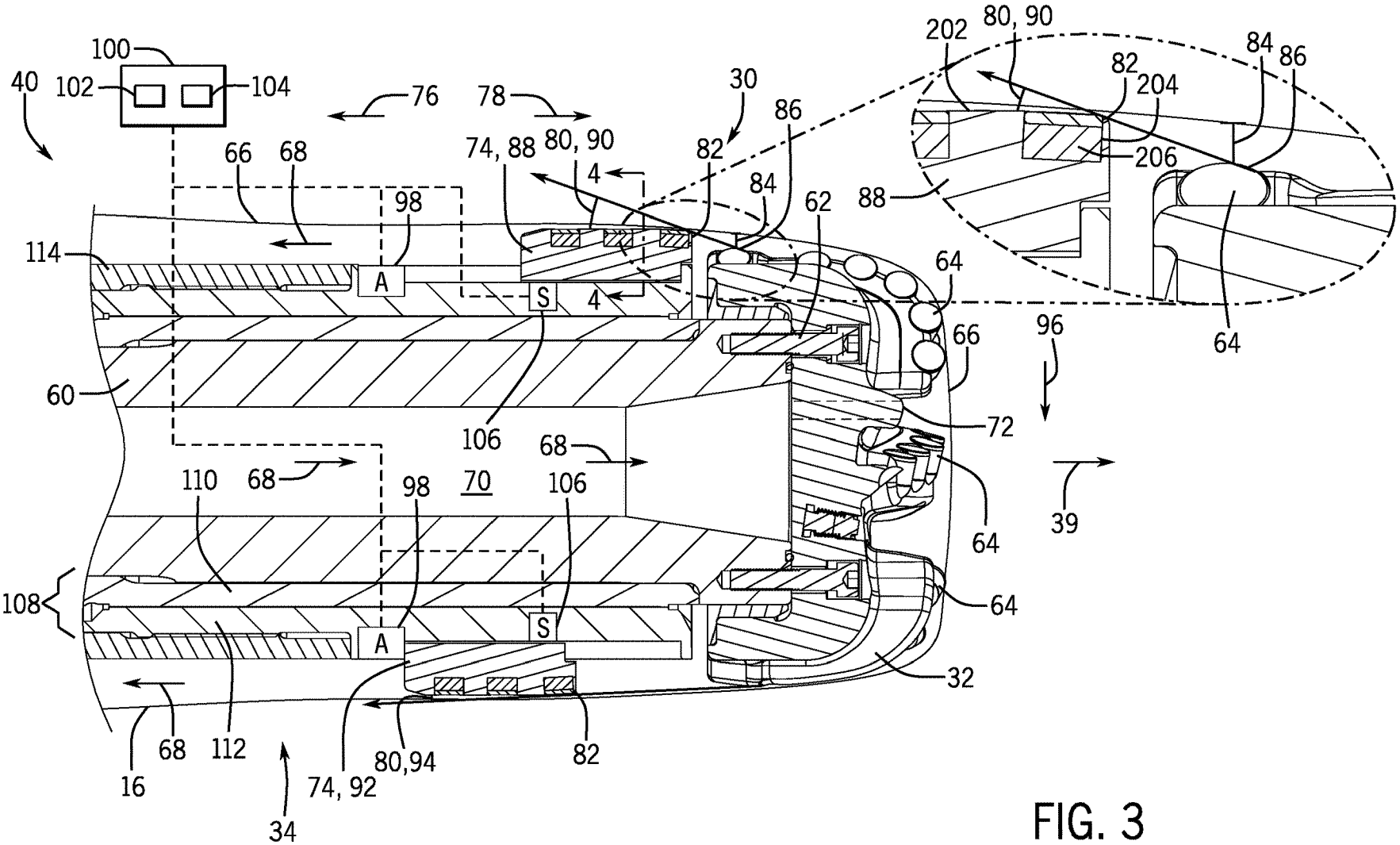
FIG. 3 is a cross-sectional view of a directional drilling system with a steering system according to an embodiment of the present disclosure.

FIG. 3 is a cross-sectional view of an embodiment of a directional drilling system 30 with a rotary steering system 40 of the present disclosure. As explained above with reference to FIG. 2, the directional drilling system 30 includes at bottom a drill bit 32 capable of cutting through rock and/or sediment to drill a borehole for a well 16. The drill bit 32 may be powered by a motor (e.g., hydraulic or mud motor, electric motor) that in operation transfers torque to the drill bit 32 through a drive shaft 60. The drill bit 32 may couple to the drive shaft 60 with one or more bolts 62 enabling power transfer from the motor. As the drive shaft 60 rotates, torque drives rotation of the drill bit 32, enabling cutters or teeth 64 (e.g., polycrystalline diamond teeth) to grind into the rock face 66. As the teeth 64 grind against the rock face 66, the rock face 66 breaks into pieces called cuttings. The cuttings are then carried away from the rock face 66 with drilling mud 68. The drilling mud 68 flows through a conduit or passageway 70 in the drive shaft 60 and then through openings, nozzles or apertures 72 in the drill bit 32, carrying the cuttings around the drill bit 32 and back through the recently drilled bore.

In order to steer the directional drilling system 30 and more specifically control the orientation of the drill bit 32, the directional drilling system 30 includes the steering system 40. The steering system 40 in FIG. 3 includes one or more steering pads 74 (e.g., one, two, three, four, five, six or more steering pads). The steering pads 74 are configured to move axially in channels in direction 76 away from the drill bit 32 as well as in direction 78 toward the drill bit 32 to control the drilling direction 39. More specifically, each steering pad 74 forms a steering angle 80 between the drill bit 32 (e.g., outermost surface of a cutter 64 of the drill bit 32) and an edge 82 of the steering pad 74. This steering angle 80 increases as the steering pads 74 move axially in direction 78 toward the drill bit 32 and decreases as the steering pads 74 move axially in direction 76 away from the drill bit 32.

As illustrated, the steering pad 74 extends a radial distance 84 beyond the outermost radial surface as defined by the outermost cutter extension in the radial direction of the drill bit 32, which places the steering pad(s) 74 into contact with the rock face 66 surrounding the bore. In other words, the steering pad 74 is over-gauge, and the radial distance 84 is an over-gauge radial distance. For example, the over-gauge radial distance 84 may be in a range between about 0.1 to 20 mm, 0.1 to 10 mm, and/or 0.1 to 5 mm. In embodiments, the steering sleeve also may include an under-gauge section opposite the over-gauge section, as described in U.S. patent application Ser. No. 15/945,158, incorporated by reference herein in entirety for all purposes.

By contacting the rock face 66 the steering pads 74 are able to (passively) force the drill bit 32 in a particular direction (i.e., steer the drill bit 32). The magnitude of the direction change is controlled by the relative axial position of the steering pads 74 with respect to the drilling bit 32. In other words, the greater the steering angle 80, the greater the change in the drilling direction 39. Similarly, the smaller the steering angle 80, the smaller the change in the drilling direction 39. The angle 80 may also decrease to a point where the influence of the steering pads 74 is negligible or nonexistent, enabling the drill bit 32 to drill straight.

As illustrated, a first steering pad 88 of the steering pads 74 is at a position proximate the drill bit 32. In this position, the first steering pad 88 maximizes a steering angle 80, 90 between the first steering pad 88 and the drill bit 32. On an opposite side of the directional drilling system 30 is a second steering pad 92 of the steering pads 74. The second steering pad 92 is in a distal position relative to the drill bit 32. In this position, the second steering pad 92 minimizes a steering angle 80, 94 between the second steering pad and the drill bit 32. In these positions, the contact between the rock face 66 and the first steering pad 88 drives the drill bit in direction 96 as it drills, while the influence of second steering pad 92 is minimal or nonexistent on the drilling direction 39.

The steering pads 74 (e.g., 88, 92) may be controlled by actuators 98. These actuators 98 may be hydraulic actuators and/or mechanical actuators. For example, hydraulic actuators may use the pressure of drilling fluid flowing through the directional drilling system 30 to control the position of the steering pads 74. In some embodiments, the actuators 98 may be mechanical such as jackscrews or some other type of mechanical actuator capable of controlling the position of the steering pads 74 relative to the drilling bit 32.

To control the position of the steering pads 74, and thus the drilling direction 39 of the drill bit 32, the steering system 40 may include a controller 100 a processor 102 and a memory 104. For example, the processor 100 may be a microprocessor that executes software to control the operation of the actuators 98. The processor 102 may include multiple microprocessors, one or more "general-purpose" microprocessors, one or more special-purpose microprocessors, and/or one or more application specific integrated circuits (ASICS), or some combination thereof. For example, the processor 102 may include one or more reduced instruction set (RISC) processors.

The memory 104 may include a volatile memory, such as random access memory (RAM), and/or a nonvolatile memory, such as read-only memory (ROM). The memory 104 may store a variety of information and may be used for various purposes. For example, the memory 104 may store processor executable instructions, such as firmware or software, for the processor 102 to execute. The memory may include ROM, flash memory, a hard drive, or any other suitable optical, magnetic, or solid-state storage medium, or a combination thereof. The memory may store data, instructions, and any other suitable data.

In operation, the controller 100 may receive feedback from one or more sensors 106, for example, position sensors to detect the position of the steering pads 74 with respect to the drill bit 32, rotational speed sensors to detect collar revolutions per minute (RPM), and/or other sensors for real-time feedback of system parameters. Using feedback from the sensors 106, the controller 100 is able to control the actuators 100 to adjust the position of the steering pads 74 and control the drilling direction 39 of the drill bit 32. The controller 100 may be located on the rig 14 and/or with the measurement-while-drilling system 42 on the drill string 34, for example.

In some embodiments, the axial position of one or more steering pads 74 may be adjusted manually. For example, the directional drilling system 30 may drill into the earth to a certain depth. After reaching this depth the drill string 34 may be withdrawn along with the steering system 40. At the surface (e.g., rig 14), an operator may manually adjust the axial position of one or more steering pads 74 before again lowering the drill string 34. The directional drilling system 30 may then drill at an adjusted drilling direction 39 until the drilling direction 39 is again changed by withdrawing the drill string 34 and manually adjusting the axial position of one or more steering pads 74.

In some embodiments, the steering pads 74 may couple to a bearing system 108 that enables the shaft 60 to rotate while blocking rotation of the steering pads 74. The bearing system 108 may include an inner bearing 110 and an outer bearing 112 (e.g., sleeve). The inner bearing 110 couples to and rotates with the shaft 60, while the outer bearing 112 couples to a housing 114 (e.g., a mud motor housing).

Figure 4:
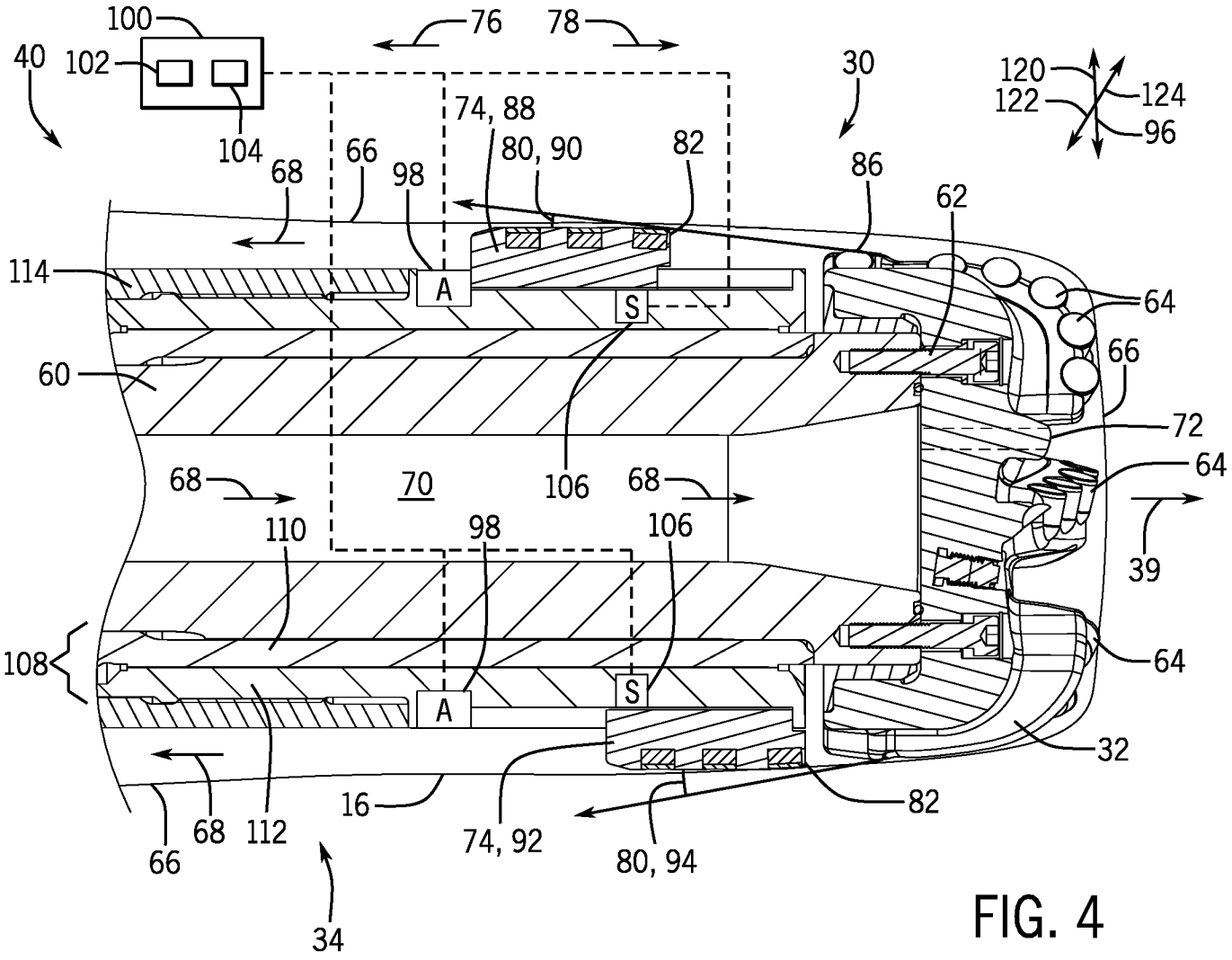
FIG. 4 is a cross-sectional view of a directional drilling system with a steering system according to an embodiment of the present disclosure.

FIG. 4 is a cross-sectional view of an embodiment of a directional drilling system 30 with a steering system 40 of the present disclosure. As explained above, the steering system 40 includes steering pads 74 that contact the rock face 66 to change the drilling direction 39 of the drill bit 32. More specifically, as shown, the steering pads 74 move axially toward and away from the drill bit 32 in directions 78 and 76, respectively, to control the drilling direction 39 of the drill bit 32. By moving axially toward and away from the drill bit 32, the steering pads 74 change their respective steering angles 80 between the drill bit 32 (e.g., outermost radially extending surface of a cutter 64 of the drill bit 32) and edges 82 of the steering pads 74. The steering angle 80 increases as the steering pads 74 move axially toward the drill bit 32 in direction 78 (see, e.g., steering angle 94), and the steering angle 80 decreases as the steering pads 74 move axially away from the drill bit 32 in direction 76 (see, e.g., steering angle 90).

In FIG. 3, a first steering pad 88 is shown proximate to the drill bit 32, which increases the steering angle 80 to a steering angle 90 between the first steering pad 88 and the drill bit 32. In contrast, a second steering pad 92 is shown distally positioned relative to the drill bit 32, which decreases the steering angle 80 to a steering angle 94 between the second steering pad and the drill bit 32. In these positions, the contact between the rock face 66 and the first steering pad 88 will drive the drill bit 32 in direction 96 and thus change the drilling direction 39, while the influence of the second steering pad 92 will be minimal or nonexistent on the drilling direction 39.

In FIG. 4, the first steering pad 88 is shown in a position moved axially away from the drill bit 32 in direction 76. In this position, the first steering pad 88 reduces (e.g., minimizes) the steering angle 90 between the first steering pad 88 and the drill bit 32. In contrast, the second steering pad 92 has been moved axially toward the drill bit 32 in direction 78. In this position, the second steering pad 92 increases (e.g., maximizes) the steering angle 94 between the second steering pad and the drill bit 32. In these positions, the contact between the rock face 66 and the second steering pad 88 drives the drill bit 32 and thus the drilling direction 39 in direction 120, while the influence of the first steering pad 88 is minimal or nonexistent on the direction of the drilling. The magnitude of the change in the drilling direction 39 is controlled by the relative axial position of the steering pad(s) 74 (e.g., 88 and 92) with respect to the drilling bit 32. That is, the greater the steering angle 80, the greater the change in the drilling direction 39, and the smaller the steering angle 80, the smaller the change in the drilling direction 39.

As explained above, the steering system 40 may include additional steering pads 74 (e.g., two, three, four, five, six or more steering pads). For example, in embodiments, the steering system 40 may include a third steering pad and a fourth steering pad that are radially offset from the first and second steering pads 88, 92. For example, the third and fourth steering pads may be radially offset from each other by one hundred and eighty degrees and from the first and second steering pads 88, 92 by ninety degrees. In these positions, the third and fourth steering pads 74 enable the steering system 40 to change the drilling direction 39 of the drill bit 32 in directions 122 and 124 as they move axially in directions 76 and 78 and change their respective steering angles 80 with the drill bit 32.

In embodiments, there may be only one steering pad 74 that is adjusted with the actuator 98 or adjusted manually. Accordingly, in order to change the drilling direction 39 (e.g., in directions 120, 122, 124) the drill string 34 may be rotated in order to position the steering pad 74 in a different circumferential position with respect to the bore.

Figure 5:
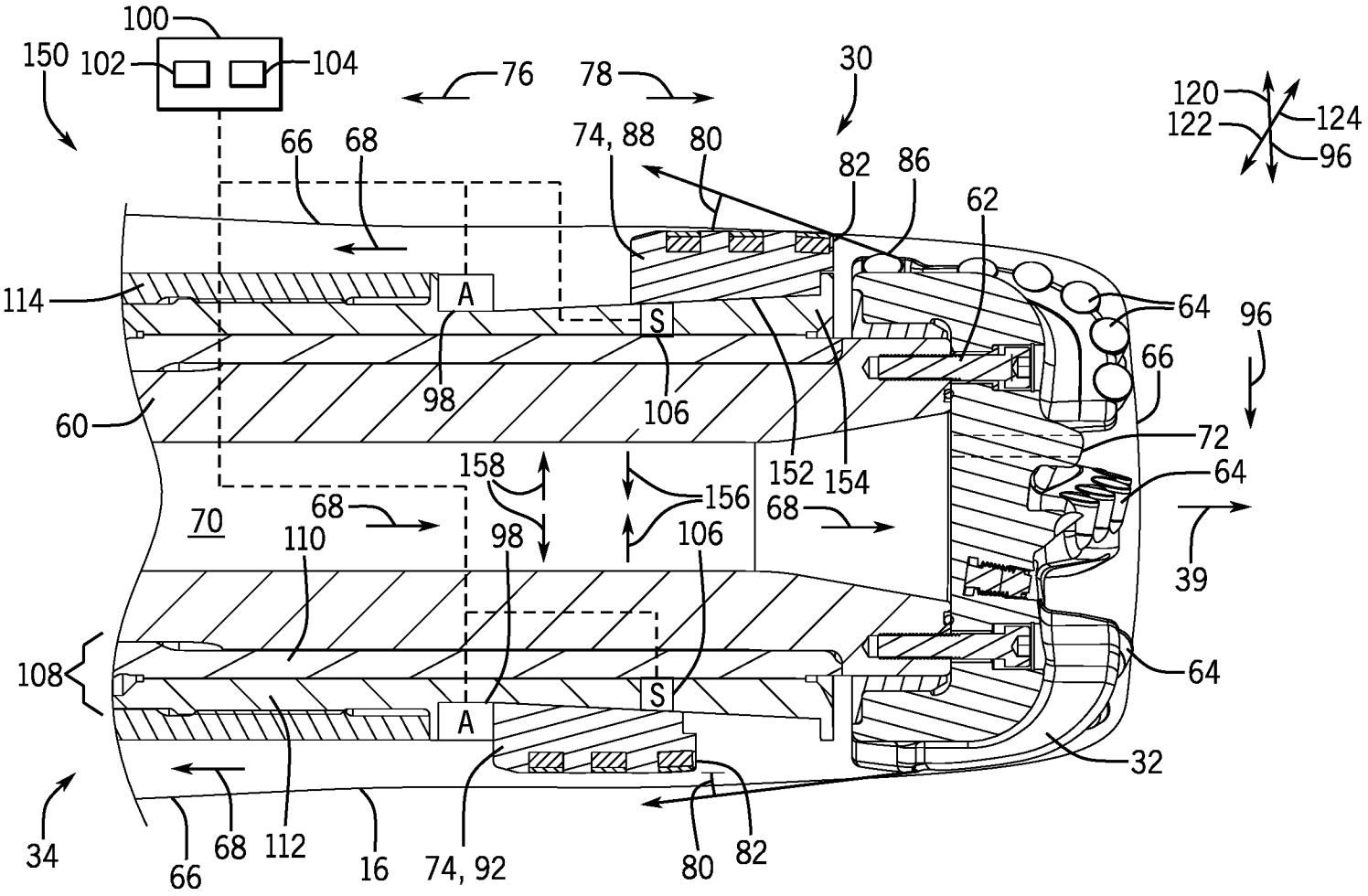
FIG. 5 is a cross-sectional view of a directional drilling system with a steering system according to an embodiment of the present disclosure.

FIG. 5 is a cross-sectional view of an embodiment of a directional drilling system 30 with a steering system 150.

The steering system 150 operates similarly to steering system 40 described with reference to FIGS. 3 and 4. However, with steering system 150 the steering pads 74 move both axially and radially. As illustrated, the steering pads 74 rest in respective channels 152 in the outer bearing 112. The channels 152 form an angle with the outermost surface 154 of the outer bearing 112. As the actuators 98 drive the steering pads 74, the steering pads 74 move both radially and axially with respect to the outer bearing 112. More specifically, as the steering pads 74 move in axial direction 76, the steering pads 74 move axially away from the drill bit 32 and radially inward in direction 156. In contrast, as the steering pads 74 move in axial direction 78 toward the drilling bit 32, the steering pads 74 move radially outward in direction 158. In some embodiments, this ability to radially retract/extend the steering pads 74 as they move axially may enable a rapid change of the steering angles 80 as well as reduce the possibility that the steering pads 74 will lodge in the rock face 66.

The steering system 150 may include additional steering pads 74 (e.g., two, three, four, five, six or more steering pads) radially offset from the steering pads 74 (88 and 92) seen in FIG. 5. For example, the steering system 150 may include third and fourth steering pads 74 radially offset from each other by one hundred and eighty degrees and from the visible steering pads 74 in FIG. 5 by ninety degrees. In these positions, the third and fourth steering pads 74 enable the steering system 150 to change the drilling direction 39 of the drill bit 32 in directions 122 and 124 as they move axially in directions 76 and 78.

Figure 6:
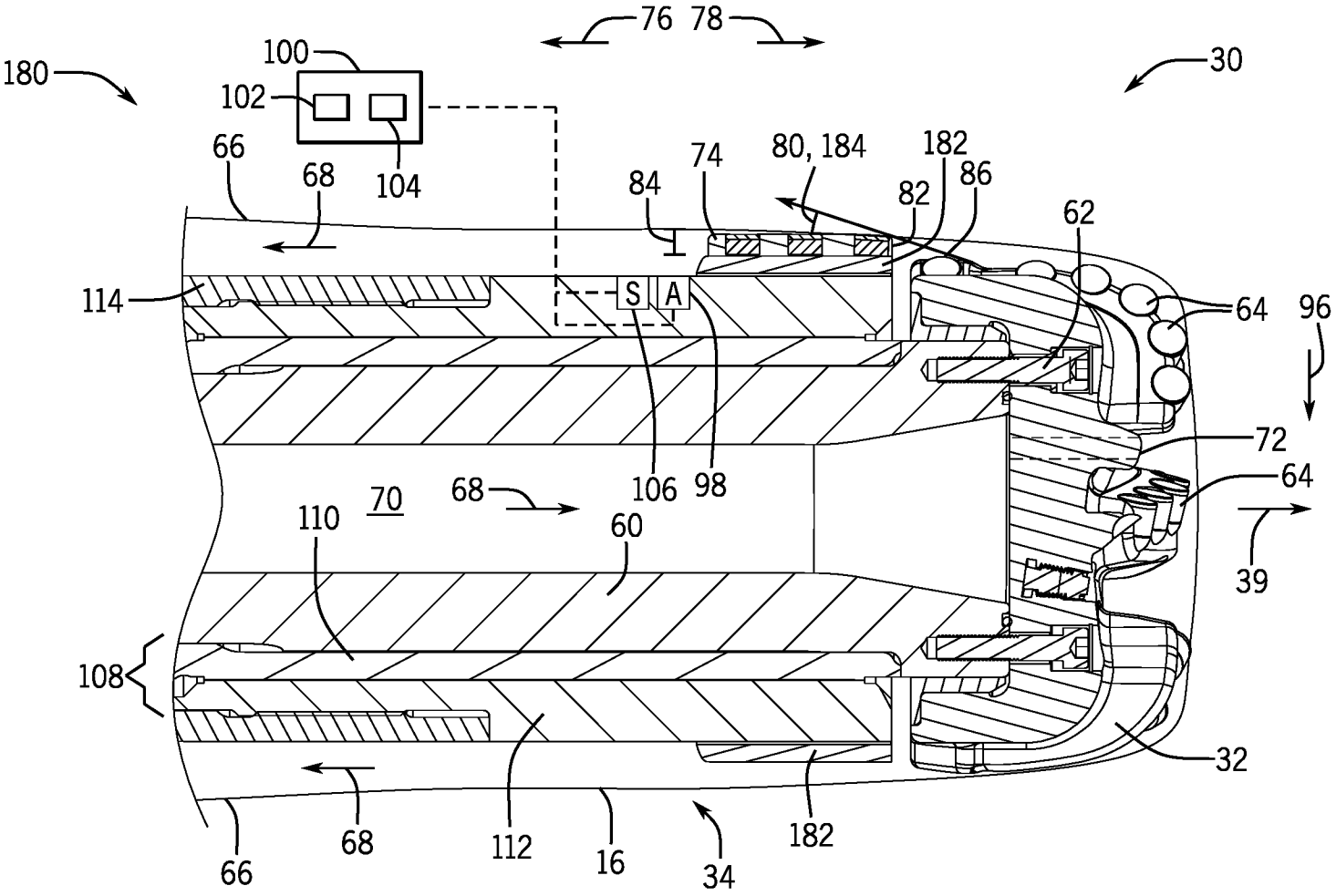
FIG. 6 is a cross-sectional view of a directional drilling system with a steering system according to an embodiment of the present disclosure.

FIG. 6 is a cross-sectional view of an embodiment of a directional drilling system 30 with a steering system 180. Similar to the steering systems 40 and 150 discussed above, the steering system 180 controls the drilling direction 39 of the drill bit 32 through axial movement of steering pads 74. The steering system 180 may include multiple steering pads 74 (e.g., two, three, four, five, six or more steering pads). These steering pads 74 couple to a sleeve 182 (e.g., a steering sleeve) capable of moving axially in directions 76 and 78 in response to actuation by one or more actuators 98. However, in embodiments containing multiple steering pads 74, the steering pads 74 are not placed about the entire circumference of the sleeve 182. Instead, one or more steering pads 74 extend over a discrete arc of the sleeve 182. For example, the arc may measure between about 1 to 90 degrees, 1 to 60 degrees, 1 to 30 degrees, and/or 1 to 15 degrees.

As explained above, the steering pad(s) 74 forms a steering angle 80 between the drill bit 32 (e.g., outermost surface of a cutter 64 of the drill bit 32) and an edge 82 of the steering pad 74. This steering angle 80 increases as the steering pad 74 moves axially in direction 78 toward the drill bit 32 and decreases as the steering pad 74 moves axially away from the drill bit 32 in direction 76. By moving the sleeve 182 in axial directions 76 and 78, the steering system 180 is able to move the steering pad(s) 74, which in turn controls the drilling direction 39 of the drill bit 32. More specifically, each steering pad 74 extends a radial distance 84 past the outermost radial surface 86 (outermost radial extension of a cutter 64) of the drill bit 32, placing the steering pad(s) 74 into contact with the rock face 66 surrounding the bore. In other words, the steering pad 74 is over-gauge, and the radial distance 84 is an over-gauge radial distance. For example, the over-gauge radial distance 84 may be in a range between about 0.1 to 20 mm, 0.1 to 10 mm, and/or 0.1 to 5 mm. In embodiments, the sleeve 182 also may include an under-gauge section opposite the over-gauge section, as described in U.S. patent application Ser. No. 15/945,158, incorporated by reference herein in entirety for all purposes.

By contacting the rock face 66, the steering pad(s) 74 can (passively) force the drill bit 32 in a particular direction (i.e., steer the drill bit 32).

The magnitude of the change in the drilling direction 39 is controlled by the relative axial position of the steering pad(s) 74 with respect to the drill bit 32. That is, the greater the steering angle 80, the greater the change in the drilling direction 39, and the smaller the steering angle 80, the smaller the change in the drilling direction 39. The steering angle 80 may decrease to a point where the influence of the corresponding steering pad(s) 74 is negligible or nonexistent. In FIG. 6, the steering pad 74 is at a position proximate the drill bit 32. In this position, the steering pad 74 has an increased (e.g., maximum) steering angle 184 between the steering pad 74 and the drill bit 32. In this position, the contact between the rock face 66 and the steering pad 74 drives the drill bit 32 in direction 96.

As illustrated, the sleeve 182 couples to the bearing system 108 that enables the shaft 60 to rotate while blocking rotation of the sleeve 182 and the steering pad(s) 74. The bearing system 108 includes an inner bearing 110 and an outer bearing 112. The inner bearing 110 couples to and rotates with the shaft 60, while the outer bearing 112 couples to a housing 114 (e.g., mud motor housing).

Figure 7:
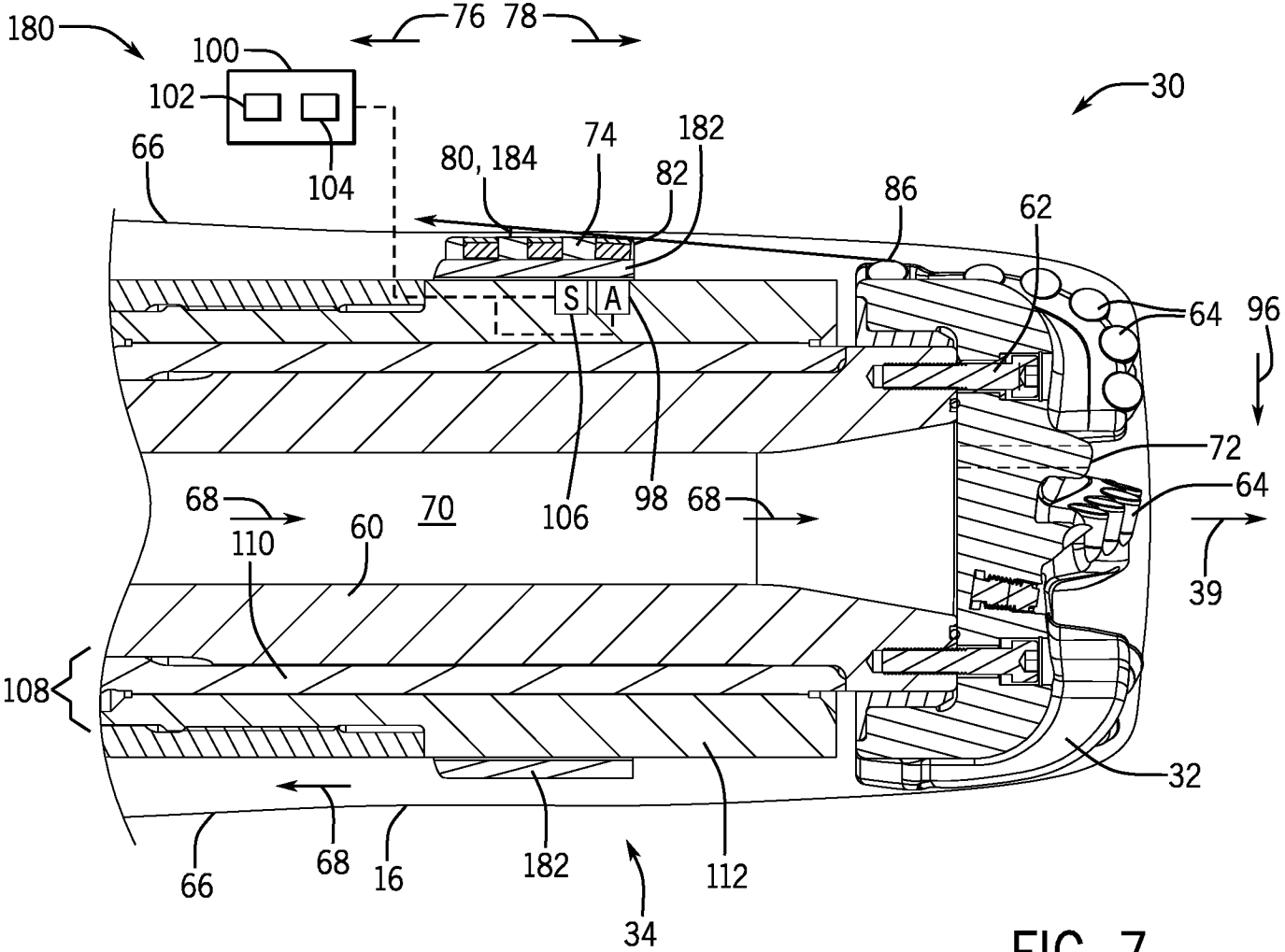
FIG. 7 is a cross-sectional view of a directional drilling system with a steering system according to an embodiment of the present disclosure.

FIG. 7 is a cross-sectional view of an embodiment of a directional drilling system 30 with the steering system 180. In FIG. 7, the sleeve 182 has been moved axially from a position proximate the drill bit 32 to a distal position relative to the drill bit 32. The steering pad 74 has correspondingly been moved with the sleeve 182 from a position proximate the drill bit 32 to a distal position relative to the drill bit 32. In this position, the steering pad 74 decreases (e.g., minimizes) the steering angle 184 between the steering pad 74 and the drill bit 32. By reducing the steering angle 184, the ability of the steering pad 74 to change the drilling direction 39 is reduced. In other words, the drill bit 32 is able to drill in a less inclined and/or straight direction.

Figure 8:
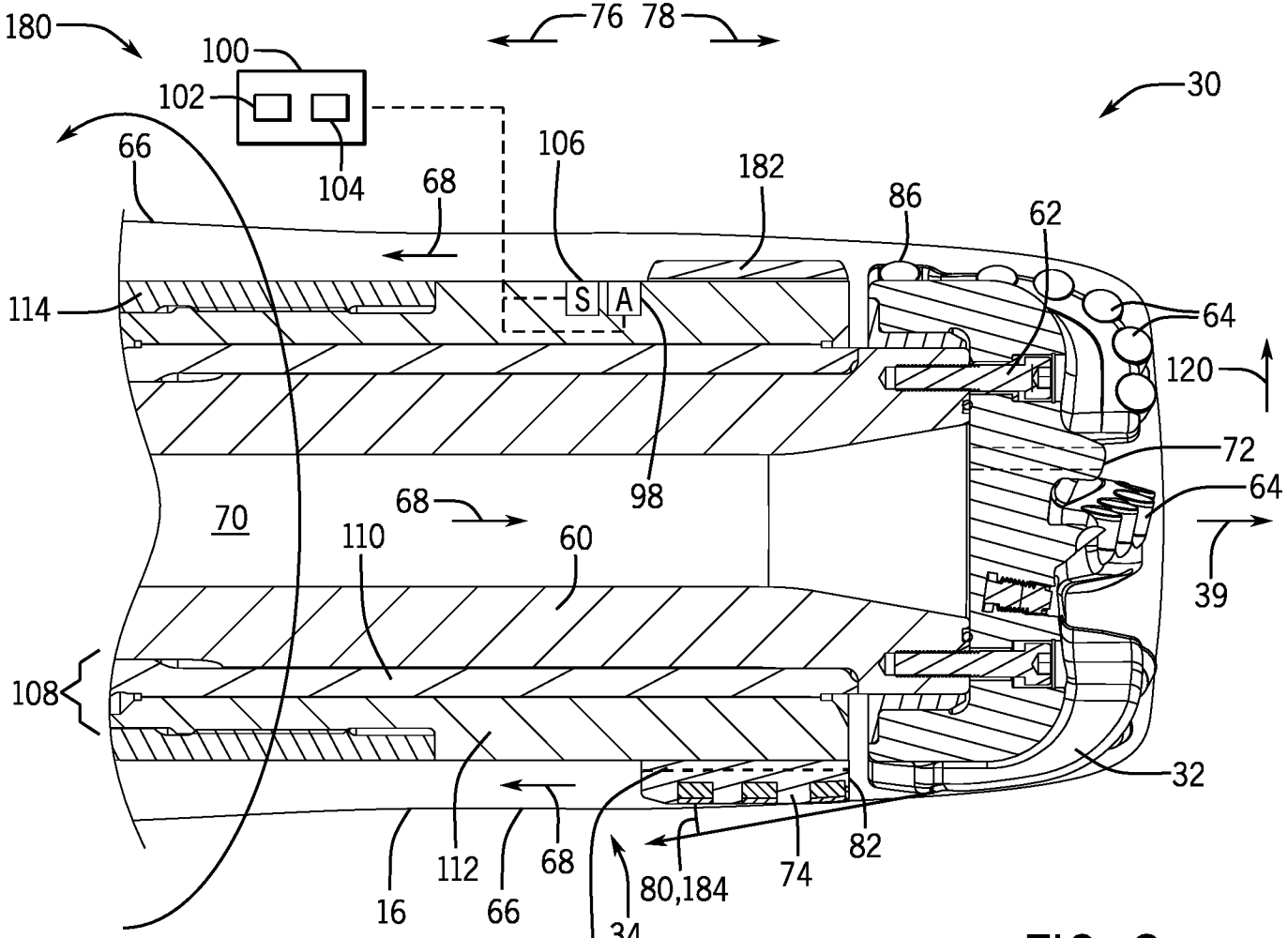
FIG. 8 is a cross-sectional view of a directional drilling system with a steering system according to an embodiment of the present disclosure.

FIG. 8 is a cross-sectional view of an embodiment of a directional drilling system 30 with the steering system 180. As explained above, the steering system 180 need not include steering pads 74 about the entire circumference of the sleeve 182. Accordingly, the sleeve 182 and steering pad(s) 74 are rotated about the shaft 60 in order to position the steering pads 74 at a different circumferential position. In some embodiments, the sleeve 182 threadingly couples to the outer bearing 112, and the outer bearing 112 couples to the motor housing 114. Accordingly, in order to rotate the sleeve 182 and the steering pad(s) 74 into a desired position, the motor housing 114 is rotated. In some embodiments, the motor housing 114 may be rotated by rotating the drill string 34, e.g. using a top drive 38 on the rig 14 (seen in FIG. 2), kelly drive and/or rotary table, or the like. After rotating the sleeve 182 and steering pad(s) 74 into position, an actuator 98 may adjust the axial position of the sleeve 182 relative to the drill bit 32 to control the drilling direction 39. As illustrated in FIG. 8, the steering pad 74 has been rotated one hundred and eighty degrees from its position in FIGS. 6 and 7. In this position, the steering pad 74 is now able to change the drilling direction 39 toward direction 120. In this way, the steering pad 74 may be positioned three hundred and sixty degrees about the shaft 60, enabling steering system 180 to change the drilling direction 39 of the drill bit 32.

Figure 9:
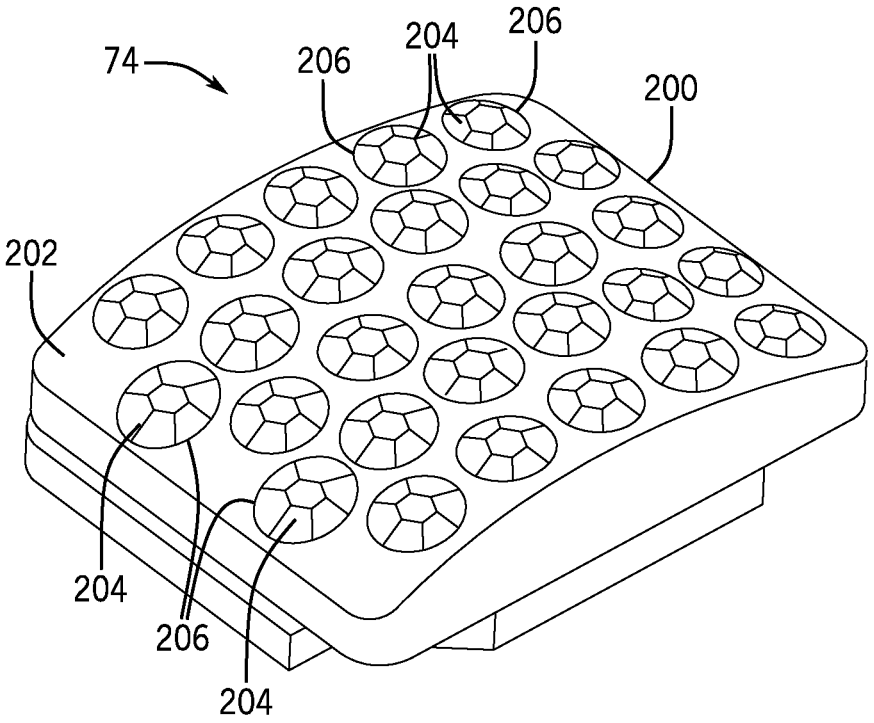
FIG. 9 is a perspective view of a steering pad according to an embodiment of the present disclosure.

FIG. 9 is a perspective view of an embodiment of a steering pad 74 of the present disclosure. In some embodiments, the steering pad 74 includes a body 200 made out of a first material such as carbide (e.g., tungsten or other transition metal carbides). The body 200 may define a curvilinear surface 202 configured to engage the rock face 66 described above (as is also shown on FIG. 3). The body 200 may also include a plurality of counterbores 204 in the curvilinear surface 202. These counterbores 204 enable the steering pad 74 to receive a plurality of inserts 206. The inserts 206 may include, for example, diamond inserts, boron nitride inserts, tungsten carbide inserts, or a combination thereof. The inserts 206 may be conventional polycrystalline diamond cutters (PDC or PCD cutters). These inserts 206 provide abrasion resistance as the steering pad 74 contacts the rock face 66.

The steering assembly of the present disclosure may be part of, or fixedly coupled or adjustably coupled to, a mud motor, a turbine, an electric motor, or any other suitable component along a drill string. The steering assembly of the present disclosure may be manufactured, formed, or assembled separately from, or as an integral part of (in a single piece) with, any one or more of such other drill string component(s).

The embodiments discussed above are susceptible to various modifications and alternative forms, specific embodiments have been shown by way of example in the drawings and have been described in detail herein. However, it should be understood that the embodiments are not intended to be limited to the particular forms disclosed.

The invention claimed is:

1. A directional drilling system, comprising:

a drill bit;

a shaft coupled to the drill bit, wherein the shaft is configured to transfer rotational power from a motor to the drill bit;

a steering system configured to control a drilling direction of the drill bit, the steering system comprising:

a sleeve coupled to the shaft;

a first steering pad coupled to the sleeve, wherein the first steering pad is configured to form a steering angle with the drill bit, and wherein axial movement of the first steering pad with respect to the drill bit and the sleeve within a range of motion is configured to change the drilling direction by changing the steering angle, wherein the first steering pad is over-gauge a radial distance relative to the drill bit within the range of motion, and the steering system is proximate the drill bit and no more than about 400 times the radial distance from the drill bit; and a second steering pad coupled to the sleeve opposite the first steering pad, wherein the second steering pad is over-gauge relative to the drill bit.

2. The system of claim 1, wherein the first steering pad is configured to move axially and radially to change the steering angle.

3. The system of claim 1, wherein the first steering pad is configured to move axially and radially simultaneously to change the steering angle.

4. The system of claim 1, wherein the system is configured such that the steering angle decreases as the first steering pad moves axially away from the drill bit and the steering angle increases as the first steering pad moves axially toward the drill bit.

5. The system of claim 1, comprising a first actuator configured to axially move the first steering pad.

6. The system of claim 5, wherein the first actuator comprises at least one of a hydraulic actuator and a mechanical actuator.

7. The system of claim 5, wherein the first actuator is configured to axially move the first steering pad relative to the sleeve and the drill bit.

8. The system of claim 1, wherein the first steering pad comprises polycrystalline diamond.

9. The system of claim 1, comprising a third steering pad radially offset from the first steering pad wherein the third steering pad is configured to contact a rock surrounding a bore and to move axially with respect to the drill bit to change the drilling direction, wherein the third steering pad is over-gauge relative to the bit.

10. The system of claim 9, comprising a third actuator configured to axially move the third steering pad.

11. A directional drilling system, comprising:

a drill bit;

a shaft coupled to the drill bit, wherein the shaft is configured to transfer rotational power from a downhole motor to the drill bit; and a steering system configured to control a drilling direction of the drill bit, the steering system disposed between the drill bit and the downhole motor, the steering system comprising:

a steering sleeve coupled to the shaft;

a first steering pad coupled to an outer surface of the steering sleeve, wherein the first steering pad is configured to form a steering angle with the drill bit, and wherein axial movement of the steering sleeve within a range of motion with respect to the drill bit is configured to change the drilling direction by changing the steering angle, wherein the first steering pad is over-gauge within the range of motion; and a second steering pad coupled to the steering sleeve opposite the first steering pad, wherein the second steering pad is over-gauge relative to the drill bit.

12. The system of claim 11, wherein the steering angle decreases as the steering sleeve moves axially away from the drill bit and wherein the steering angle increases as the steering sleeve moves axially toward the drill bit.

13. The system of claim 11, comprising an actuator configured to axially move the steering sleeve.

14. The system of claim 13, wherein the actuator comprises at least one of a hydraulic actuator and a mechanical actuator.

15. The system of claim 11, comprising a third steering pad coupled to the steering sleeve and radially offset from the first steering pad and the second steering pad.

16. A directional drilling system, comprising:

a steering system configured to control a drilling direction of a drill bit, the steering system comprising:

a sleeve disposed about a drive shaft of a motor;

the drive shaft configured to couple directly to the drill bit;

a steering pad coupled to an outer surface of the sleeve, wherein there is only one steering pad on the sleeve, the steering pad is configured to form a steering angle with the drill bit, and wherein axial movement of the steering pad with respect to the drill bit within a range of motion is configured to change the drilling direction by changing the steering angle, wherein the steering pad is configured to move axially relative to the sleeve, and the steering pad is over-gauge a radial distance between 0.1 to 20 mm for positions within the radial distance; and wherein the system is configured such that the steering angle decreases as the steering pad moves axially away from the drill bit and the steering angle increases as the steering pad moves axially toward the drill bit.

17. The system of claim 16, wherein the steering pad is configured to move axially and radially to change the steering angle.

18. The system of claim 16, wherein the steering pad is configured to move axially and radially simultaneously to change the steering angle.

19. The system of claim 16, comprising an actuator configured to axially move the steering pad.

* * * * *